US006761146B1

(12) United States Patent
Livshiz et al.

(10) Patent No.: US 6,761,146 B1
(45) Date of Patent: Jul. 13, 2004

(54) MODEL FOLLOWING TORQUE CONTROL

(75) Inventors: Michael Livshiz, Ann Arbor, MI (US); Onassis Matthews, Novi, MI (US); Joseph R. Dulzo, Novi, MI (US); Donovan L. Dibble, Utica, MI (US); Scott J. Chynoweth, Fenton, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/463,166

(22) Filed: Jun. 17, 2003

(51) Int. Cl.[7] ..... F02D 41/14; F02G 9/10
(52) U.S. Cl. ..... 123/361; 123/399
(58) Field of Search ..... 123/361, 399

(56) References Cited

U.S. PATENT DOCUMENTS 5,233,530 A * 8/1993 Shimada et al. ..... 123/361
5,625,558 A * 4/1997 Togai et al. ..... 123/399
5,979,404 A * 11/1999 Minowa et al. ..... 123/399
6,157,888 A * 12/2000 Suzio et al. ..... 123/399
6,612,287 B2 * 9/2003 Pursifull ..... 123/399

* cited by examiner

*Primary Examiner*—Erick Solis
(74) *Attorney, Agent, or Firm*—Christopher DeVries

(57) ABSTRACT

A torque control system for a vehicle including an internal combustion engine, an electronic throttle coupled to the internal combustion engine, a powertrain controller controlling the electronic throttle, a first control loop operating in the powertrain controller including a feed forward function to control engine torque, a second control loop operating in the powertrain controller including a proportional function acting upon the torque variance in the internal combustion engine, a third control loop operating in the powertrain controller including an integral function acting upon the rpm variance in the internal combustion engine, and where the outputs of the first, second and third control loop are used to factor a desired mass airflow for the engine and the desired mass air flow is used to generate a position command for the electronic throttle.

7 Claims, 2 Drawing Sheets

MODEL FOLLOWING TORQUE CONTROL

TECHNICAL FIELD

The present invention relates to a vehicle control system. More specifically, the present invention relates to a method and apparatus to control the powertrain of a vehicle.

BACKGROUND OF THE INVENTION

Presently, speed and torque (power) control for many different types of internal combustion engines (ICEs) is provided by throttle plate control. A throttle plate is a control device coupled with an intake manifold in an engine to control the air flow through an engine. An ICE may be characterized as an air pump such that at any RPM the mass flow rate of air into the ICE varies directly with throttle plate position. As a driver depresses an accelerator pedal in a vehicle, the throttle plate moves to allow more air flow into the ICE and thus more power. A controller regulates the fuel supplied to the ICE as a function of the air flow. Typically, the air/fuel mixture is controlled to stoichometry.

SUMMARY OF THE INVENTION

The present invention is a method and apparatus for controlling the torque of an internal combustion engine utilizing electronic throttle control (ETC). The present invention is designed to be integrated into a coordinated torque control system (CTC) to improve the modularity, robustness and performance of an engine control system.

The present invention includes a series of software control modules contained in an engine or powertrain controller, although other vehicle controllers are considered within the scope of the present invention. The software control modules directly or indirectly control the position of an electronic throttle to improve the torque control accuracy for transient and steady state conditions, reduce engine to engine variation influence on system performance, and reduce calibration time. The present invention is able to accurately estimate the engine state and torque under varying conditions.

DESCRIPTION OF THE PREFERRED EMBODIMENT

Figure 1:
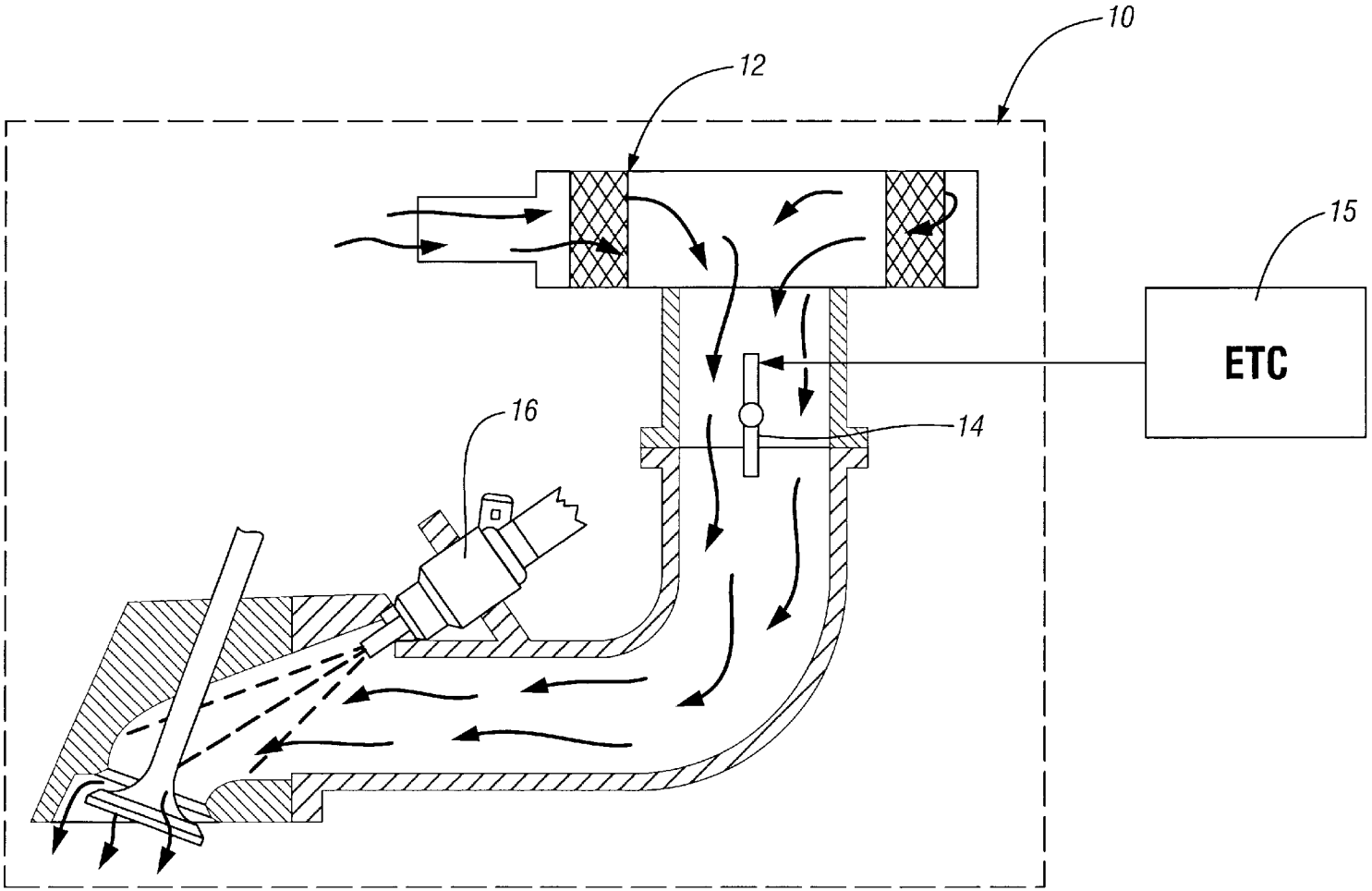
FIG. 1 is a diagrammatic drawing illustrating the throttle control of an internal combustion engine.

FIG. 1 is a diagrammatic drawing illustrating the throttle control of an internal combustion engine (ICE) 10. The ICE 10 includes an intake manifold 12 and an electronically controlled throttle plate 14. An ETC controller 15 controls the position of the throttle plate 14. Fuel injector(s) 16 provide fuel to be mixed with incoming air from the intake manifold 12. Generally, the air/fuel mixture is controlled to stoichiometry. The electronic throttle plate 14 may utilize any known electric motors or actuation technology in the art including, but not limited to, DC motors, AC motors, permanent magnet brushless motors, and reluctance motors. The ETC control includes power circuitry to modulate the electronic throttle and circuitry to receive position and speed input from the throttle plate 14. The ETC controller 15 further includes communication circuitry such as a serial link or automotive communication network interface to communicate with a powertrain controller and transmission controller. The powertrain controller will transmit a throttle position/area variable to the controller 15. In alternate embodiments of the present invention, the controller 15, powertrain, and transmission controllers may be fully integrated into one control device.

Figure 2:
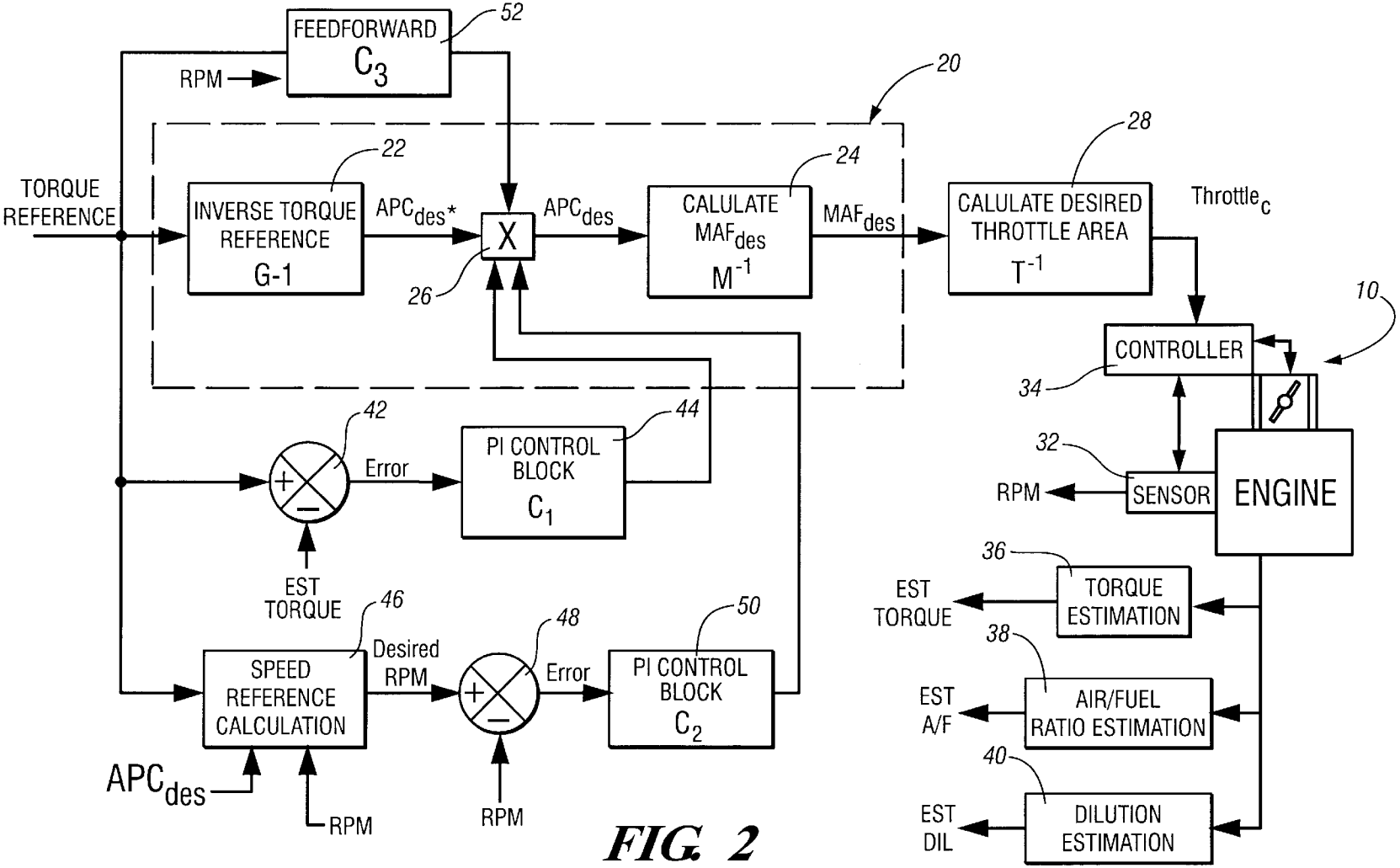
FIG. 2 is a control diagram illustrating the high level architecture of the present invention.

FIG. 2 is a diagram of the high level software architecture or structure of the present invention. Inverse models of the desired torque or mass air per cylinder and throttle position are used to generated the desired cylinder air flow rate, desired cylinder air mass, and desired throttle position based on an engine torque request. The control system includes three basic feedback control loops and an open loop control routine influencing the desired cylinder air flow rate. The first control loop (Cl) provides correction of error between a torque reference and estimate value. The second control loop (C2) modifies cylinder air flow rate accordingly. The calibration of C1 and C2 is done in a manner to avoid cycling and conflict between the control loops C1 and C2. In the present invention, C1 is calibrated to minimize dynamic errors and C2 operates in steady state conditions. The third control loop (C3) provides correction of desired cylinder air rate flow under relatively fast occurring transient conditions. The ratio of commanded and estimated cylinder air flow rate is used to modify desired cylinder air flow rates. The use of C3 enables the present invention to utilize engine power as fast as it is available.

Referring to FIG. 2, a torque reference is generated by an operator of the vehicle. The torque reference is input to what shall be described as an air flow control stage 20. The torque reference is processed by block 22 where it is converted to an inverse model of torque equivalent to an air flow rate through each cylinder. The function can be described as:

$$APC_{des}{}^{*}=(Treq_{des}/(\eta_{Af}\times\eta\#))-T_{OT}-a_R\times R^2-a_s\times R\times S-a_s\times R\times S^2$$

where:

$APC_{des}{}^{*}$ is the desired air per cylinder without correction;

$Treq_{des}$ is the engine torque request;

$\eta_{Af}$ is the efficiency of engine torque relating to air to fuel ratio change;

$\eta\#$ is the efficiency of torque to number of cylinders;

$T_{OT}$ is the extra torque to overcome friction caused by reduced engine oil temperature;

$a_R$ is the sensitivity of torque to RPM change;

R is the engine RPM;

S is the spark advance in terms of spark angle.

The output, $APC_{des}{}^{*}$, of block 22 is processed at multiplication block 26 with correction factors from the control blocks C1, C2, and C3 to generate the desired air per cylinder $APC_{des}$.

ti $APC_{des}=APC_{des}{}^{*}\times O_{C1}\times O_{C2}\times O_{C3}$ where:

$APC_{des}$ is the desired air per cylinder with control correction;

$APC_{des}{}^{*}$ is the desired air per cylinder without correction;

$O_{C1}$ is the output of the C1 controller of block 44;

$O_{C2}$ is the output of the C2 controller of block 50; and $O_{C3}$ is the output of the C3 controller of block 52.

$APC_{des}$ is processed at block 24 to generate a desired mass air flow, $MAF_{des}$ for the ICE 10 for command of the electronic throttle 14. The command $MAF_{des}$ is generated by the following equation:

$$MAF_{des}=(APC_{des}\times R)/K$$

where:

$APC_{des}$ is the desired air per cylinder;

R=engine RPM; and

K=constant related with number of cylinders, for example for a V8 engine K=15.

The command $MAF_{des}$ is input to the final throttle position command at block 28 for the ICE 10. The throttle position command may be any permutation of throttle position, error and rotation. The output of block 28 is generated by the following equation:

$$Throttle_C=(MAF_{des}\times\sqrt{(RT)})/(B\times\phi\times(MAP/B))$$

where:

$Throttle_C$ is the throttle command to the electronic throttle equivalent to throttle area;

$MAF_{des}$ is the command for the desired MAF;

R is universal gas constant;

T is ambient air temperature;

B is ambient pressure;

$\phi$ is the air density conversion factor; and

MAP is the manifold pressure in the ICE 10.

The ICE 10 includes sensors 32 such as speed, pressure and temperature sensors, and controllers 34 to monitor and control the ICE 10. A torque estimation block 36 generates and estimates engine torque based on manifold pressure or other variables. An air/fuel ratio estimation block 38 generates and estimates air/fuel ratio. A dilution estimation block 40 generates a dilution estimate based on exhaust gas recirculation or valve overlap for an ICE equipped with a cam phaser.

The estimated torque is input to a subtraction block 42 where it is subtracted from the estimated torque reference to generate an error term. The error term is acted upon by control loop C1 in block 44 to generate a signal to compensate for torque error at block 26. Control loop C1, as previously described, is a proportional-integral control block that is designed to generate appropriate control action to compensate for the error term. The torque reference is further input to a speed reference calculation block 46 that combines the estimated dilution, estimated air/fuel ratio, estimated torque and measure ICE 10 rpm to generate a desired RPM using the following equation:

$$RPM_{des}=((Treq_{des}/(\eta_{AF}\times\eta_{\#}))-T_{OT}-a_{APC}\times R\times APC_{meas}-a_s\times R\times S-a_s^2\times R\times S^2)/(a_R\times R)$$

where:

$RPM_{des}$ is the desired RPM for the ICE 10;

$APC_{des}$ is the desired air per cylinder;

$Treq_{des}$ is the engine torque request;

$\eta_{Af}$ is the efficiency of engine torque relating to air to fuel ratio change;

$\eta\#$ is the efficiency of torque to number of cylinders;

$T_{OT}$ is the extra torque to overcome friction caused by reduced engine oil temperature;

$a_R$ is the sensitivity of torque to RPM change;

R is the engine RPM;

$a_{APC}$ is a constant;

$a_s$ is a constant;

R is the engine RPM; and

S is the spark advance.

The actual RPM is subtracted from the desired RPM at subtraction block 48 to generate an error term. The error term is acted upon by control loop C2 at block 50 to generate a signal to compensate for RPM error that is processed at block 26. Control block C2 is also a PI control that is designed to generate appropriate control action to eliminate this error. RPM error may be caused by engine to engine variations and by inaccuracy of estimated APC, AF and dilution. The control loop C3 at block 52 based on the torque reference and engine speed generates a signal that is also processed at block 26.

In the present invention, the control loop C1 may be characterized as a proportional control function or proportional and integral function, the control loop C2 may be characterized as a proportional and integral control function, and the control loop C3 may be characterized as the feedforward control function. The outputs of these three control loops C1, C2, and C3 are combined with the desired air per clinder to generate the desired air per cylinder for the ICE 10 at block 26.

While this invention has been described in terms of some specific embodiments, it will be appreciated that other forms can readily be adapted by one skilled in the art. Accordingly, the scope of this invention is to be considered limited only by the following claims.

What is claimed is:

1. A torque control system for a vehicle comprising:

an internal combustion engine;

an electronic throttle coupled to said internal combustion engine;

a powertrain controller controlling said electronic throttle;

a first control loop operating in said powertrain controller including a feed forward function to control engine torque;

a second control loop operating in said powertrain controller including a proportional function acting upon the torque variance in said internal combustion engine;

a third control loop operating in said powertrain controller including an integral function acting upon the rpm variance in said internal combustion engine; and wherein the outputs of said first, second and third control loop are used to factor a desired mass airflow for the engine and the desired mass air flow is used to generate a position command for said electronic throttle.

2. The torque control system of claim 1, wherein said internal combustion engine includes a speed sensor.

3. The torque control system of claim 1, wherein said internal combustion engine includes a manifold pressure sensor.

4. The torque control system of claim 1, wherein said powertrain controller includes a torque estimation block.

5. The torque control system of claim 1, wherein said electronic throttle communicates with said powertrain controller over an automotive communication network.

6. A method of controlling the torque of an internal combustion engine comprising:

providing an electronic throttle to control air flow to said internal combustion engine;

generating a first throttle value from an open loop torque reference control block based on desired torque;

generating a second throttle value based on the torque error in said internal combustion engine;

generating a third throttle value based on RPM error in said internal combustion engine;

combining said first, second, and third throttle values to produce a desired mass air flow for the engine that is used to generate a throttle command for said electronic throttle.

7. The method of claim 6 further comprising generating a fourth throttle value based on feedforwarding the actual rpm of the internal combustion engine.

* * * * *